US008646432B1

(12) United States Patent
McAlister et al.

(10) Patent No.: US 8,646,432 B1
(45) Date of Patent: Feb. 11, 2014

(54) FLUID INSULATED INJECTOR-IGNITER

(71) Applicants: McAlister Technologies, LLC, Phoenix, AZ (US); Advanced Green Technologies, Chandler, AZ (US)

(72) Inventors: Roy Edward McAlister, Phoenix, AZ (US); David Leigh Grottenthaler, Phoenix, AZ (US); Ryan Kennedy Kemmet, Phoenix, AZ (US)

(73) Assignee: McAlister Technologies, LLC, Phoenix, AZ (US)

( * ) Notice: Subject to any disclaimer, the term of this patent is extended or adjusted under 35 U.S.C. 154(b) by 0 days.

(21) Appl. No.: 13/797,776

(22) Filed: Mar. 12, 2013

Related U.S. Application Data

(60) Provisional application No. 61/712,758, filed on Oct. 11, 2012.

(51) Int. Cl.
*F02M 57/06* (2006.01)

(52) U.S. Cl.
USPC ..... 123/297

(58) Field of Classification Search
USPC ..... 123/297, 298, 151, 152, 490, 498, 499, 123/169 E, 169 EL, 169 MG, 608; 313/120, 313/124, 130, 131 R, 136, 141, 143–145; 239/585.1–585.5, 102.2
See application file for complete search history.

(56) References Cited

U.S. PATENT DOCUMENTS

| | | | | |
|---|---|---|---|---|
| 6,712,035 | B2 * | 3/2004 | Gottemoller et al. | 123/297 |
| 6,969,009 | B2 * | 11/2005 | Bachmaier et al. | 239/102.2 |
| 8,413,634 | B2 * | 4/2013 | McAlister | 123/297 |
| 8,517,284 | B2 * | 8/2013 | Ibrahim et al. | 239/132 |
| 2003/0010848 | A1 * | 1/2003 | Laumen | 239/585.1 |
| 2008/0143229 | A1 * | 6/2008 | Walker | 313/143 |
| 2010/0183993 | A1 * | 7/2010 | McAlister | 431/254 |
| 2011/0125391 | A1 * | 5/2011 | McAlister | 701/104 |
| 2011/0146619 | A1 * | 6/2011 | McAlister | 123/297 |
| 2011/0297753 | A1 * | 12/2011 | McAlister et al. | 239/5 |
| 2012/0139406 | A1 * | 6/2012 | Allgaier et al. | 313/141 |
| 2012/0145125 | A1 * | 6/2012 | McAlister | 123/445 |
| 2012/0216782 | A1 * | 8/2012 | McAlister | 123/472 |
| 2013/0020415 | A1 * | 1/2013 | Aye et al. | 239/585.1 |
| 2013/0043323 | A1 * | 2/2013 | McAlister | 239/5 |
| 2013/0074333 | A1 * | 3/2013 | McAlister | 29/887 |

* cited by examiner

*Primary Examiner* — Stephen K Cronin
*Assistant Examiner* — Joseph Dallo
(74) *Attorney, Agent, or Firm* — Perkins Coie LLP

(57) ABSTRACT

A system for transferring and igniting a fuel comprising a fuel supply and a cryogenic fuel processor connected to the fuel supply and operative to remove impurities from the fuel. The system includes a power supply and an injector-igniter. The injector-igniter includes an injector housing connected to the power supply and having a fuel inlet connected to the fuel processor. An actuator body is disposed in the housing and a conductor sleeve is connected to the power supply and supported between the actuator body and injector housing with a first annular gap between the injector housing and the conductor sleeve. There is also a second annular gap between the actuator body and conductor sleeve, wherein the first and second annular gaps are in fluid communication with the fuel inlet, whereby fuel provides a dielectric between the conductor sleeve and the injector housing.

20 Claims, 10 Drawing Sheets

FLUID INSULATED INJECTOR-IGNITER

CROSS-REFERENCE TO RELATED APPLICATION

The present application claims the benefit of U.S. Provisional Patent Application No. 61/712,758, filed Oct. 11, 2012, the disclosure of which is hereby incorporated by reference in its entirety.

BACKGROUND

A long standing problem of instrumentation devices, spark plugs, grid delivery cable stand-offs, and other electrical components and systems is containment and protection of elevated voltage for delivery of energy that ranges from signal strength to much higher power levels at kilovolt or megavolt magnitudes. For example, a high voltage power line insulator must provide a critical stand-off distance from the conductor support to the insulator support to prevent arc-over through the atmosphere including rain, wet surfaces, ice, and snow, along with pollutant condensates that may form electrolytes. Similarly, spark plugs generally include a critical porcelain dimension between the central electrode and an external conductor, such as the typical threaded metal mounting fitting, in order to prevent arc-discharge along the interface within the ambient air and fumes including salt water sprays, lubricant by-products, and exhaust condensates that surround the spark plug in the combustion chamber.

As combustion engines become more complex and compact, there is a need to reduce the volume of space occupied by insulators (e.g., ceramic or porcelain) in an engine's cylinder head. In many cases where high voltage insulation is used in complex ignition system components, the insulator must be custom made to fit the particular application, adding to the cost of the end component. In addition, the insulator material is often fragile and is bulky when sufficiently thick to provide the necessary dielectric strength, which significantly constrains system design. Accordingly, there is a need for more space efficient electrical insulators. There is a further need for space efficient electrical insulators that provide design flexibility making them suitable for use in complex, compact ignition and fuel system components.

BRIEF DESCRIPTION OF THE DRAWINGS

Non-limiting and non-exhaustive embodiments of the devices, systems, and methods, including the preferred embodiment, are described with reference to the following figures, wherein like reference numerals refer to like parts throughout the various views unless otherwise specified.

DETAILED DESCRIPTION

Figure 1:
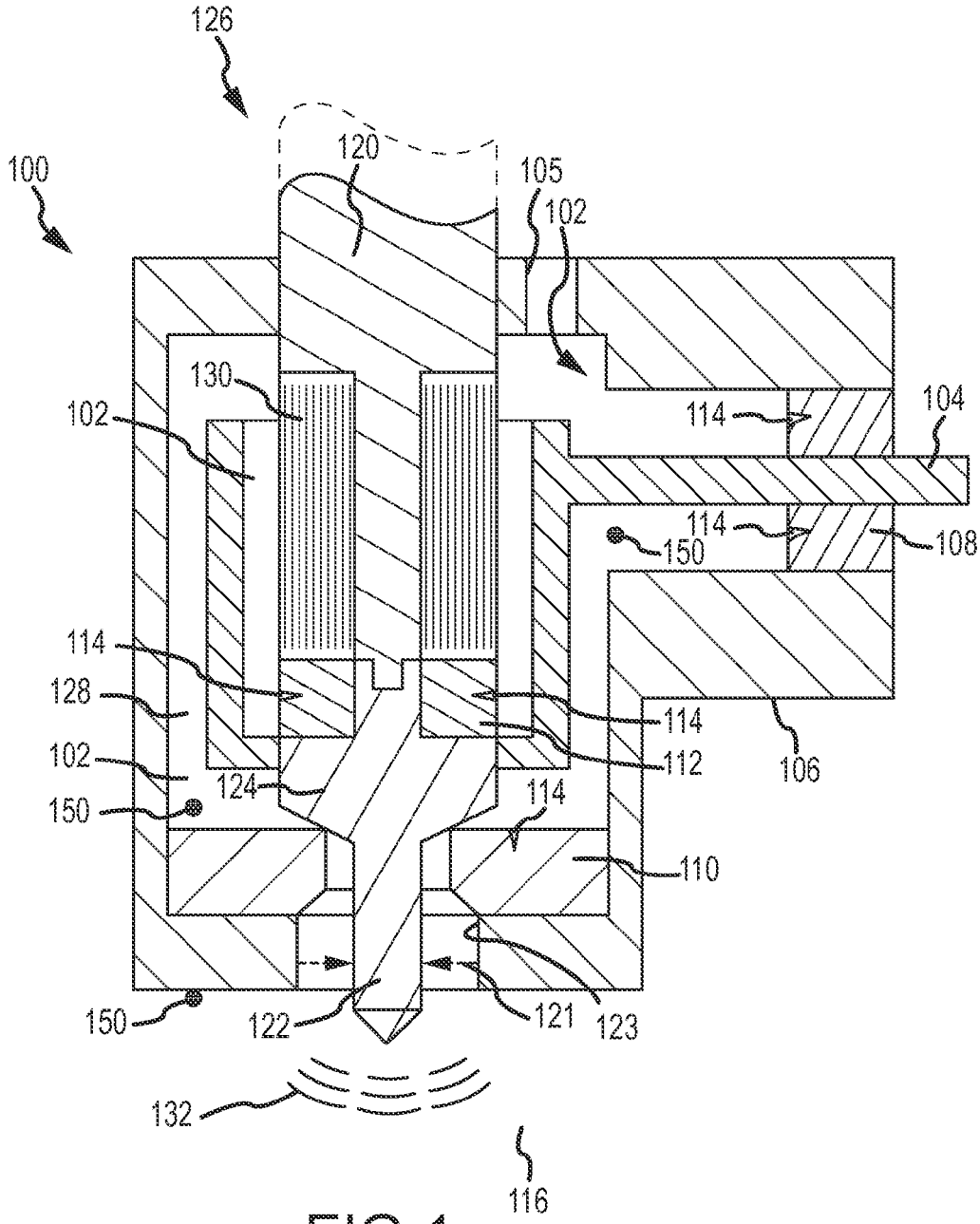
FIG. 1 is a cross-sectional representation of an injector-igniter incorporating a fluid dielectric according to a representative embodiment.

Disclosed herein are ignition systems for igniting a fuel and systems for transferring and igniting a fluid fuel. In an embodiment, the system comprises a voltage potential generation means. An electrically conductive means conveys a voltage generated by the voltage potential generation means and a combination of a solid dielectric means and a fluid dielectric means insulate the electrically conductive means. A delivery means delivers the voltage to cause ignition of the fuel. In one aspect of the disclosed technology, the fluid dielectric means includes at least one of an inert dielectric substance and the fuel. In some embodiments, the system further comprises a fluid processing means for removing fluid impurities from the fluid dielectric means, wherein the fluid processing means includes a fluid impurities collection means for collecting the fluid impurities for later use. In other aspects of the technology, the fluid processing means comprises cooling the fluid dielectric means to a cryogenic temperature. In an embodiment, the system further comprises a sensor means for sensing impurities in the fluid dielectric means.

Also disclosed herein are systems for transferring and igniting a fluid fuel. In a representative embodiment, the system comprises a voltage potential generation means, a conductive means for conveying voltage generated by the voltage potential generation means, and a combination of a solid dielectric means and a fluid dielectric means for insulating the conductive means. A transfer means transfers the fluid fuel and a delivery means delivers the voltage to cause ignition of the fuel. In one aspect of the present technology, the system may further comprise an adaptive timing means for repeated delivery of the fluid fuel and an ionization means for ionizing the fuel.

In another embodiment, a system for transferring and igniting a fuel comprises a fuel supply and a cryogenic fuel processor connected to the fuel supply and operative to remove impurities from the fuel. The system further comprises a power supply and an injector-igniter. The injector-igniter includes an injector housing connected to the power supply and having a fuel inlet connected to the fuel processor. An actuator body is disposed in the housing and a conductor sleeve is connected to the power supply and supported between the actuator body and injector housing with a first annular gap between the injector housing and the conductor sleeve. There is also a second annular gap between the actuator body and conductor sleeve, wherein the first and second annular gaps are in fluid communication with the fuel inlet, whereby fuel provides a dielectric between the conductor sleeve and the injector housing. A first electrode is electrically connected to the conductor sleeve and a second electrode is electrically connected to the housing.

Disclosed herein are fuel injector-igniters according to the present technology. In a representative embodiment, a fuel injector-igniter comprises an injector housing, an actuator body disposed in the housing, and a conductor sleeve supported between the actuator body and injector housing with a first annular gap between the injector housing and the conductor sleeve. There is also a second annular gap between the actuator body and the conductor sleeve. The first and second annular gaps are in fluid communication with a fuel inlet, whereby fuel provides a dielectric between the conductor sleeve and the injector housing. In some embodiments, the injector-igniter further comprises an outwardly opening valve. In yet other embodiments, the injector-igniter further comprises a piezoelectric actuator and a hydraulic stroke amplifier disposed in the actuator body and operatively connected to the outwardly opening valve. In one aspect of the disclosed technology, the fuel provides a dielectric between the conductor sleeve and actuator body. In still other aspects of the disclosed technology the injector-igniter is adapted to use compressed natural gas. In an embodiment, the injector-igniter further comprises a first electrode electrically connected to the conductor sleeve and a second electrode electrically connected to the housing.

Specific details of several embodiments of the technology are described below with reference to FIGS. 1-11. Other details describing well-known fuel system and ignition components, such as fuel pumps, regulators, and the like, have not been set forth in the following disclosure to avoid unnecessarily obscuring the description of the various embodiments of the technology. Many of the details, dimensions, angles, and other features shown in the figures are merely illustrative of particular embodiments of the technology. Accordingly, other embodiments can have other details, dimensions, angles, and features without departing from the spirit or scope of the present technology. A person of ordinary skill in the art, therefore, will accordingly understand that the technology may have other embodiments with additional elements, or the technology may have other embodiments without several of the features shown and described below with reference to FIGS. 1-11.

Some aspects of the technology described below may take the form of or make use of computer-executable instructions, including routines executed by a programmable computer. Those skilled in the relevant art will appreciate that the technology can be practiced on computer systems other than those shown and described below. The technology can be embodied in a special-purpose computer or data processor, such as an engine control unit (ECU), engine control module (ECM), fuel system controller, or the like, that is specifically programmed, configured or constructed to perform one or more computer-executable instructions consistent with the technology described below. Accordingly, the term "computer," "processor," or "controller" as generally used herein refers to any data processor and can include ECUs, ECMs, and modules, as well as Internet appliances and hand-held devices (including palm-top computers, wearable computers, cellular or mobile phones, multi-processor systems, processor-based or programmable consumer electronics, network computers, mini computers and the like). Information handled by these computers can be presented at any suitable display medium, including a CRT display, LCD, or dedicated display device or mechanism (e.g., gauge).

The technology can also be practiced in distributed environments, where tasks or modules are performed by remote processing devices that are linked through a communications network. In a distributed computing environment, program modules or subroutines may be located in local and remote memory storage devices. Aspects of the technology described below may be stored or distributed on computer-readable media, including magnetic or optically readable or removable computer disks, as well as distributed electronically over networks. Such networks may include, for example and without limitation, Controller Area Networks (CAN), Local Interconnect Networks (LIN), and the like. In particular embodiments, data structures and transmissions of data particular to aspects of the technology are also encompassed within the scope of the technology.

FIG. 1 schematically illustrates an injector-igniter 100 incorporating the disclosed fluid insulator technology according to a representative embodiment. Injector-igniter 100 includes an injector body or housing 106 with a valve seat 110 disposed therein. In this embodiment, valve seat 110 comprises a solid dielectric material. A valve 120 is slideably disposed in the housing 106 and selectively confronts valve seat 110 in order to control the flow of fuel (e.g., fluid 102) into a combustion chamber 116. The valve 120 moves bidirectionally along an axial path as represented by distance 126 as shown.

Injector-igniter 100 not only injects fuel, it also provides the ignition to combust the injected fuel. Injector-igniter 100 includes electrically charged conductors 104 and housing 106. Valve 120 includes a conductive valve head 124 electrically connected to electrode 104. A suitable power supply (not shown) occasionally applies voltage through conductor 104 to charge a tip portion 122 of conductive valve head 124. In some embodiments, the charge applied to the tip is sufficient to cause an arc across the gap 121 between housing 106 and tip portion 122, thereby igniting the fuel present in combustion chamber 116. The power supply may also charge other devices, such as capacitor 130.

Dielectric fluid 102 is delivered through port 105 and is used to provide electrical isolation (e.g., insulator) between electrically charged conductors 104 and 106, for example. It should be understood that the term fluid as used in the present application refers to both liquid and gaseous fluids. For example, fluid 102 may be a liquid fluid such as gasoline or cryogenic methane or a gaseous fluid, such as compressed natural gas (CNG), which in this case one or more of such fluids are also the fuel supply to the injector. Using a dielectric fluid as the insulator in applications such as injector-igniter 100 has the additional benefit of conforming to and filling voids within the device. This conformal nature of a dielectric fluid may be enhanced by increasing the pressure of the dielectric fluid, such as by heating the fluid to increase pressure and/or by delivering the dielectric fluid at elevated pressure through a port such as 105.

Dielectric fluid 102 is used in some embodiments to help insulate variously incorporated and located electrical or thermo-electrical devices, such as integrated circuits or discrete devices such as inductors, resistors, photo-optic components, thermoelectric generators and/or capacitors such as capacitor 130 which is disposed on valve 120. This is particularly effective in providing energy harvesting and/or for intermittent energy storage in capacitor 130 and/or to enable certain functions such as rapid loading or delivery of electrical potential energy.

In other embodiments, the dynamic flow of dielectric fluid 102 through valve seat 110 insulates electrode 106 from coaxial surfaces of tip portion 122, thereby inhibiting ionization of fluid 102 across gap 121, which consequently forces corona discharge 132 at a distance into the lower dielectric strength substances present in the combustion chamber 116.

Delivering the electrical potential energy as corona ionization instead of a spark that traverses gap 121, reduces spark erosion of electrodes 122 and surface 123 of housing electrode 106.

The conforming nature of the fluid fuel and/or non-fuel creates more robust dielectric capabilities. In certain embodiments, dielectric fluid 102 also provides other functions in addition to serving as conforming dielectric substance such as smoothing surface topographies including filling cracks and crevices (e.g., 114) that may form in other solid dielectric materials 108, 110, and/or 112 to regenerate or restore voltage containment capabilities and/or for chemically reacting with newly exposed surfaces of cracks or crevices 114 to heal such cracks and/or to provide prevention of further propagation of such cracks. In this regard the conforming fluid dielectric substance may be varied in chemical makeup or contents from time to time to provide such maintenance functions. Such maintenance features for solid conductive or dielectric structures that support or contain conforming dielectric fluids provides considerable advantage to designers of voltage containment systems that encounter considerable stress including mechanical and thermal cycling induced stress.

TABLE 1

| Material | Dielectric Strength (kV/mm) |
|---|---|
| Alumina | 13.4 |
| Alumina Silica | 5.9 |
| Zirconia | 11.4 |
| Window Glass | 9.8-13.8 |
| Polysulfone | 16.7 |
| Polyethersulfone | 15.7 |
| Acetal homopolymer | 15.0 |
| Polycarbonate | 15.0 |

Figure 5:
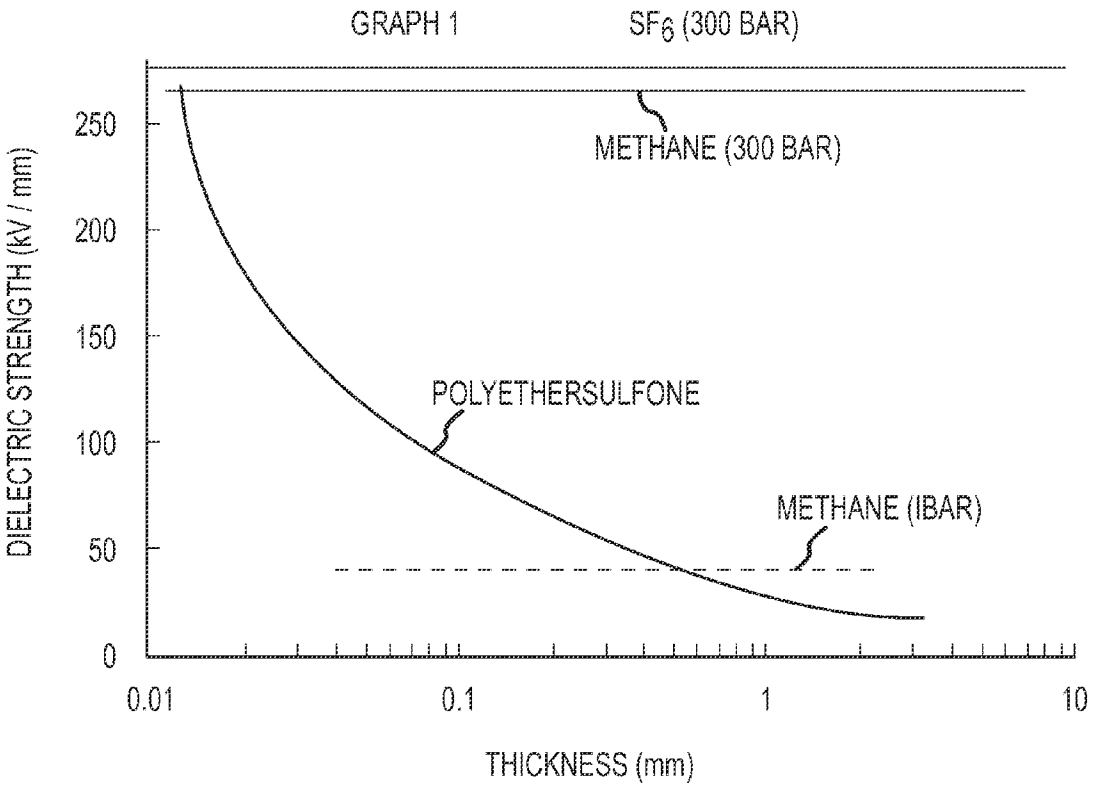
FIG. 5 is a graph illustrating dielectric strength of various materials as a function of thickness.

As shown in Table 1 above, the dielectric strength of some polymer materials is about 16.7 kV/mm for thin sections of polyethersulfone at room temperature. As shown in FIG. 5, dielectric strength of solid dielectrics such as polyethersulfone rapidly decreases with increasing thickness. In comparison the dielectric strength values for several selections of dielectric fluid substances are maintained at much thicker sections.

In fluid dielectric substances, formation of ions including negative or positive particles and electrons causes the dielectric strength to be reduced. Formation of such ions and/or electrons is a function of the electric field strength and the mean free distance that particles within the fluid travel between collisions. The higher the density of a fluid such as a gas, the shorter mean free path. Therefore, at the same temperature and in the same electric field, as pressure is increased specific gas volume is compressed causing reduction of the mean free path distance; and the electric field acceleration of electrons and larger ions produces less kinetic energy between collisions than at lower pressures. Reducing the kinetic energy of colliding particles reduces the probability for dissociation of neutral particles and accordingly the propagation rate of additional ions and electrons. Thus, the dielectric strength increases with increasing pressure as illustratively shown for methane at low pressure compared to higher pressure in FIG. 5.

As temperature increases the vibrational energy of molecules in dielectric materials, the dielectric strength of solid, liquid, and gaseous phases of dielectric substances decreases. This loss of dielectric strength is prevented or offset in some of the disclosed embodiments by providing flow of the dielectric fluid to one or more heat removal zones to prevent operation at elevated temperatures and therefore prevent the dielectric strength from declining past a preferred value.

At boundary interfaces with solid dielectric or conductive materials, increasing the surface roughness of those materials increases the intensity of the electric field and locally reduces the effective voltage containment thickness, and thus the apparent dielectric strength, of the dielectric material. As roughness, cracks, crevices, and dislocation boundaries form on the surfaces of solid materials in response to applied stresses, the fluid dielectric fills such voids to smooth the surface and effectively reduce or eliminate the roughness. In some embodiments substances that heal cracks or crevices in the solid are utilized as dielectric fluids or as additives that may be occasionally utilized to restore voltage containment capabilities. For example, ethylene, propylene, silanes, or various other organic or inorganic filling and linking substances may be used as healing or repair agents in systems that include voltage-containment fluid, including fuel selections such as methane, ethane, propane, ammonia, urea, or various carbazoles.

In some embodiments that contain light pipes or fiber optics (shown in cross section as bundles 150), repair and/or healing functions may be aided by application of energy conversion treatments, such as ultraviolet curing cycles performed with N-Vinylcarbazole or various other substances that concentrate in cracks and or become stabilized by polymerization upon being energized by ultraviolet radiation. Repair agents may be selected according to the chemistry of the solid counterparts and used continuously or occasionally for such purposes. This is especially beneficial for producing higher fatigue endurance strength of fiber optics that participate in multiple functions, such as providing event detection as sensors and/or optical transmissivity along with various roles as tensile or flexure components in mechanisms.

Figure 2:
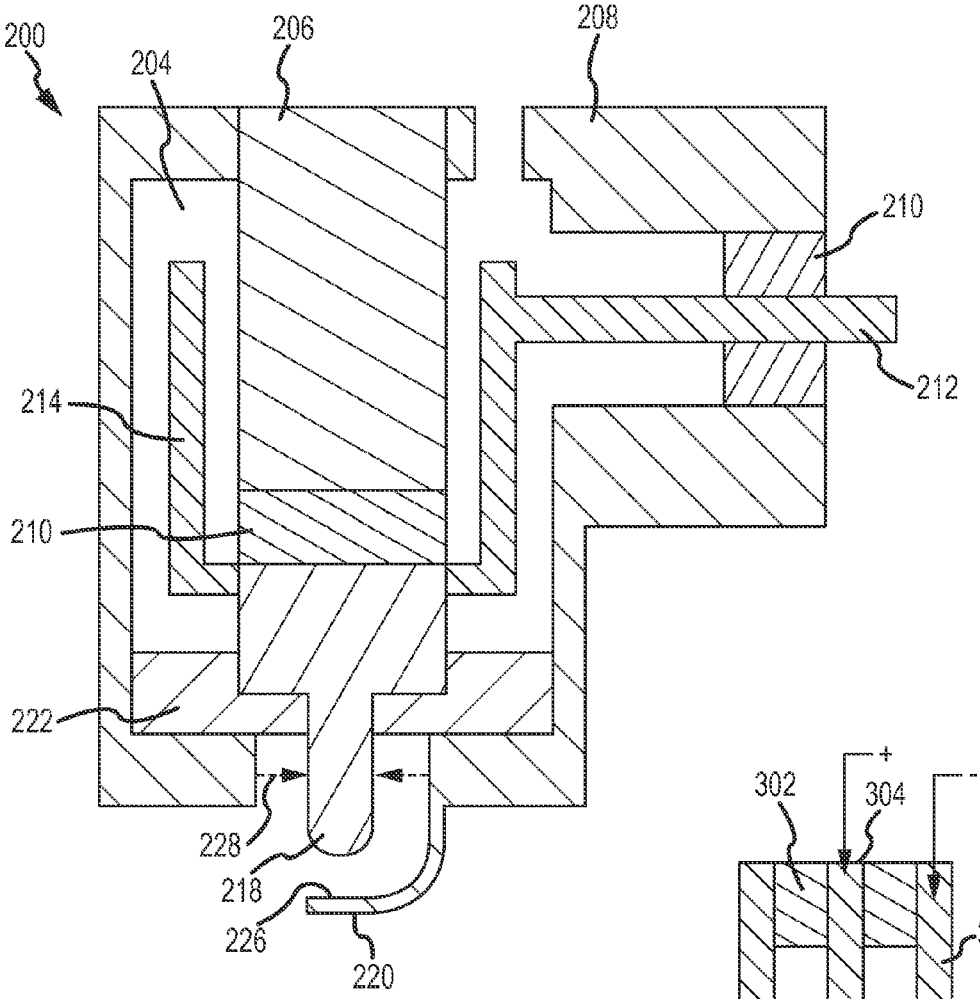
FIG. 2 is a cross-sectional representation of an ignition device according to a representative embodiment.

FIG. 2 illustrates an ignition device 200 according to a representative embodiment in which a fluid dielectric 204 helps contain voltage developed between conductive components 208 and 212. Solid dielectric 210 provides insulation between conductor 208 and 212 and may also provide containment and/or storage of conforming dielectric fluid 204 and/or crack repair agents as shown. Conductor 214 is connected and charged to the voltage of conductor 212 by a suitable power supply (not shown). Solid insulative material 210 may be a polymer or ceramic material such as shown in Table 1. Bi-directional motion of actuator assembly 206, insulator 216, and conductive component 218 provides for reducing or increasing the gap distance between electrode 220 and component 218. Varying the gap from surface 226 to 218 compared to 228 enables control of spark discharge at 226 or 228 as desired. In certain embodiments suitable passageways are provided to allow flow of dielectric fluid 204 into the zone in gap 228 and/or to 226 as a result of valve motion by conductor 218.

Figure 3:
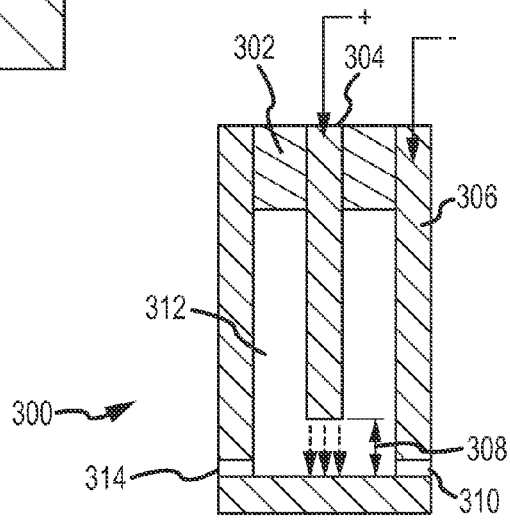
FIG. 3 is a cross-sectional representation of a sensor according to a representative embodiment.

FIG. 3 illustrates a sensor 300 according to a representative embodiment in which a fluid dielectric 312 is provided ingress or egress to a zone of interest through suitable ports 310 and/or 314. Gap 308 may be varied by axial motion of electrode 304 toward or away from conductive body 306 to measure conditions between conductive surfaces of 304 and 306, such as pressure, temperature and other properties by capacitance, ion current, ionization potential, index of refraction, electrical or thermal conductivity etc. Fiber optics or other systems for purposes such as determination of index of refraction or spectrographic differentiation may similarly benefit from operation in a fluid dielectric medium including operation in which circulation of such fluid dielectric substance provides heat exchange and/or motion functions such as heat addition or removal.

Figure 4B:
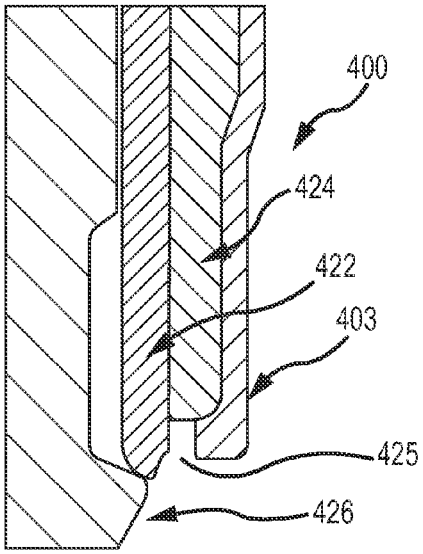
FIG. 4B is an enlarged partial cross-sectional view of the injector-igniter shown in FIG. 4A.
Figure 4A:
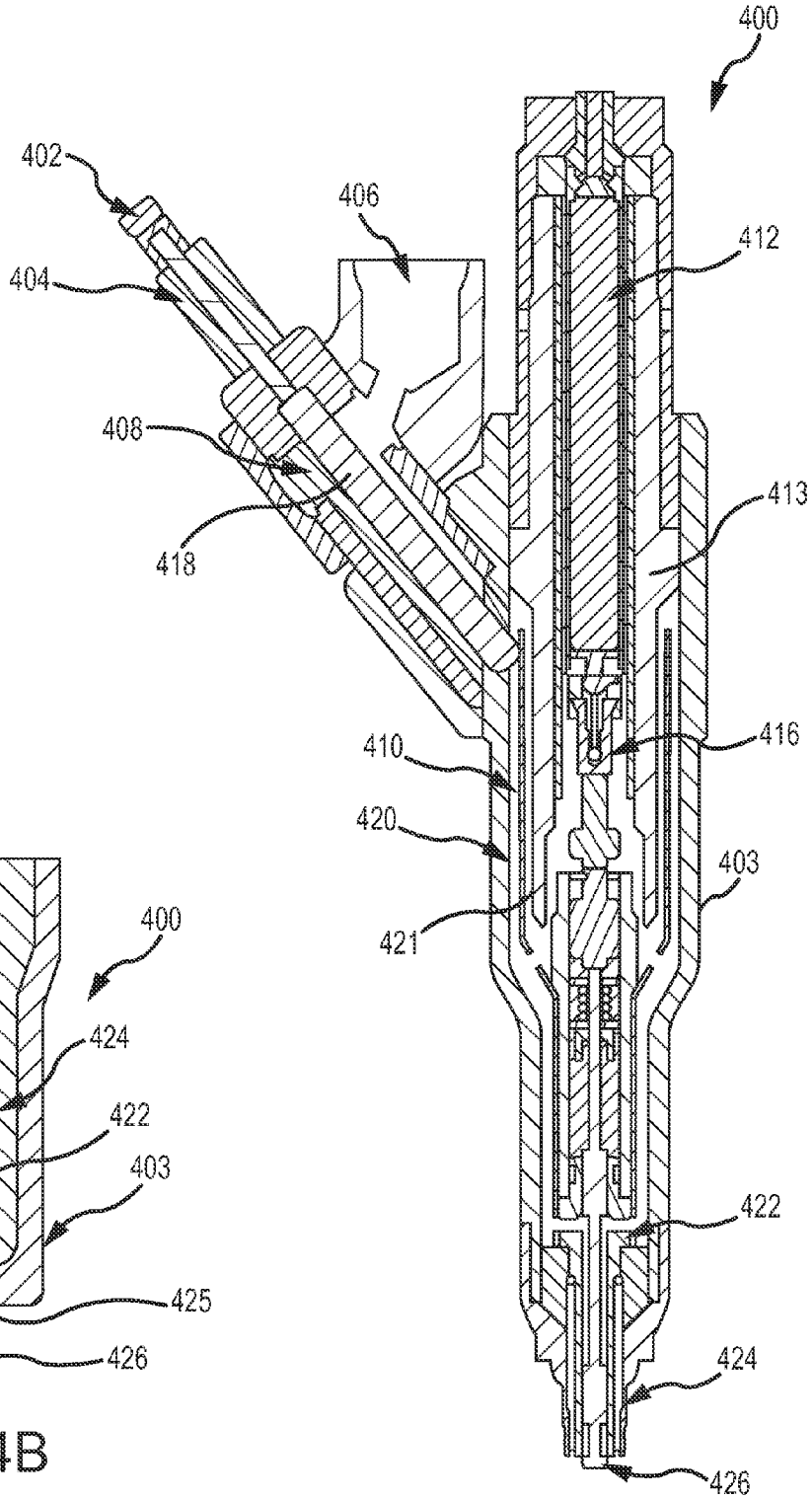
FIG. 4A is a cross-sectional side view in elevation of an injector-igniter according to another representative embodiment.

FIG. 4A illustrates injector-igniter 400 according to another representative embodiment. Injector-igniter 400 provides fuel injection and ignition functions for heat generation and/or operation of heat engines such as gas turbines, two stroke or four stroke piston engines, or various types of rotary combustion engines. Fuel selections such as traditional hydrocarbons or paraffinic selections such as butane, propane, ethane, or methane, along with various other selections such as hydrogen, ammonia or various mixtures of hydrogen and carbon monoxide including mixtures of such substances that may be used as the dielectric fluid for electrically and/or thermally participating with and/or insulating electro-mechanical, electrical, or electronic energy-conversion systems (e.g., voltage containment combined with heat exchange and/or component repair).

Injector-igniter 400 includes an injector housing 403 that contains an actuator 412 and a valve 426. Actuator 412 is operative to selectively open and close valve 426 in order to meter fuel. Actuator 412 is contained in an actuator body 413 that may also house a mechanical or hydraulic linear motion amplifier and/or thermal expansion compensator 416. Motion amplifier 416 may be used to provide a longer stroke for valve 426. A representative hydraulic stroke amplifier is disclosed in U.S. Pat. No. 5,779,149, the disclosure of which is incorporated herein by reference in its entirety. To the extent the foregoing patent and/or any other materials incorporated herein conflict with the present disclosure, the present disclosure controls.

Actuator 412 may be a solenoid, magnetostrictive, piezoelectric, pneumatic, or hydraulic actuator, for example. In certain embodiments, particularly such as those using solenoid, magnetostrictive, or piezoelectric valve actuators, dielectric fluid is provided as a cover medium on the surfaces of such devices to reduce or eliminate degradation by chemical reaction or oxidation and thus improve the fatigue endurance and stress corrosion resistance of such components. In certain embodiments, the electromechanical solenoid, magnetostrictive or piezoelectric actuator 412 is within an electrically insulating, heat exchanging, and fatigue endurance strength improving medium such as sulfur hexafluoride, 1,1,1,-trichloro-2,2,2, trifluoroethane, hydrogen, methane, butane, butanol or various other suitable substances, including mixtures containing selections of such substances. In certain embodiments, dielectric fluid mixtures include components that serve primarily to provide dielectric strength such as sulfur hexafluoride and/or another component such as a fuel constituent that serves in heat exchange processes such as hydrogen and one or more other components such as propane or propanol or butanol and/or butane that serves as a heat pipe fluid in a heat transfer cycle of phase change by evaporation of liquid phase at heat removal zones such as at or within a valve actuator or electrical energy conversion process to provide condensation at heat rejection zones.

Injector-igniter 400 is connected to a suitable power source (not shown) via terminal 402. Voltage containment is provided by porcelain insulator 404 and/or fuel/dielectric fluid 408 around conductor 418. Conductor 418 connects to tubular conductor sleeve 410, which in turn is connected to electrode 422 (also referred to herein as valve seat electrode 422), which is also the valve seat against which valve 426 opens and closes. Conductor sleeve 410 is supported between the actuator body 413 and injector housing 403 with a first annular gap 420 between the injector housing 403 and the conductor sleeve 410. There is a second annular gap 421 between the actuator body 413 and conductor sleeve 410. The first and second annular gaps 420, 421 are in fluid communication with a fuel inlet 406, whereby fuel 408 provides a dielectric between the conductor sleeve 410, injector housing 403, and actuator body 413. Thus, it can be appreciated that the fuel/dielectric fluid 408 fills in the first and second annular gaps 420, 421 to provide insulation for the electrical conductors.

With further reference to FIG. 4B, valve 426 opens and closes against valve seat electrode 422, as disclosed above. Accordingly, both the valve seat electrode 422 and valve 426 are electrically connected to terminal 402 via conductor sleeve 410. Injector housing 403 provides the return path for the power supply and therefore constitutes a second electrode. In this embodiment, both the housing 403 and electrode 422 are cylindrical, creating an annular spark gap 425 therebetween. Solid insulator 424 provides a substantial portion of the dielectric between electrode 422 and housing 403.

Ionization of fuel, oxidant and/or mixtures of fuel and oxidant within gap 425 initiates conversion of electrical energy from the power supply to thermal and kinetic energy of ions within the relatively small volume of gap 425 where one or more sparks occur. Fuel that is intermittently injected past the spark gap 425 as valve 426 is displaced from the valve seat 422 provides a flow of fuel generally below and away from the spark gap. Such fuel may be mixed with oxidant during the compression and/or expansion stroke of a piston engine and forced by compression and/or other mixing forces into the gap 425 between electrodes 422 and 403. Such fuel and oxidant mixtures may be able to ignite and release sufficient heat and/or radiation to sustain a sub-sonic chain reaction to combust a much larger distribution and/or volume of fuel and oxidant that is required for operation of the engine. The larger the gap 425 formed by electrodes 422 and 403, the greater the volume of ionized particles and the better the chance of producing a sustained sub-sonic combustion front through mixtures of fuel and oxidant. However, the larger the gap, the greater the spark erosion, thermal fatigue, and oxidation degradation of electrodes 422 and 403. In high compression engine applications, the greater dielectric strength of the compressed air or air-fuel mixture in the gap requires higher production and containment voltage which must be met by higher pressure dielectric fluid in annular gaps 420, 421 within the injector assembly.

In some embodiments, one or more phase changes of the dielectric fluid may be used to improve dielectric strength, functionality, and durability. For example, upon cooling natural gas to cryogenic temperatures, impurities such as water, carbon dioxide, oxides of sulfur, and various other substances are removed by condensation. Gaseous nitrogen, oxygen, and helium are separated upon condensation of liquid methane. This provides high dielectric strength liquid methane fluid that can be densely stored and transported and used as a dielectric substance. In other embodiments, liquid methane is heated in a confined volume to produce pressure for enhancing the dielectric strength and conformal performance in voltage containment capabilities by filling cracks and smoothing surfaces of solids that serves as dielectric and/or conductive components.

Figure 6:
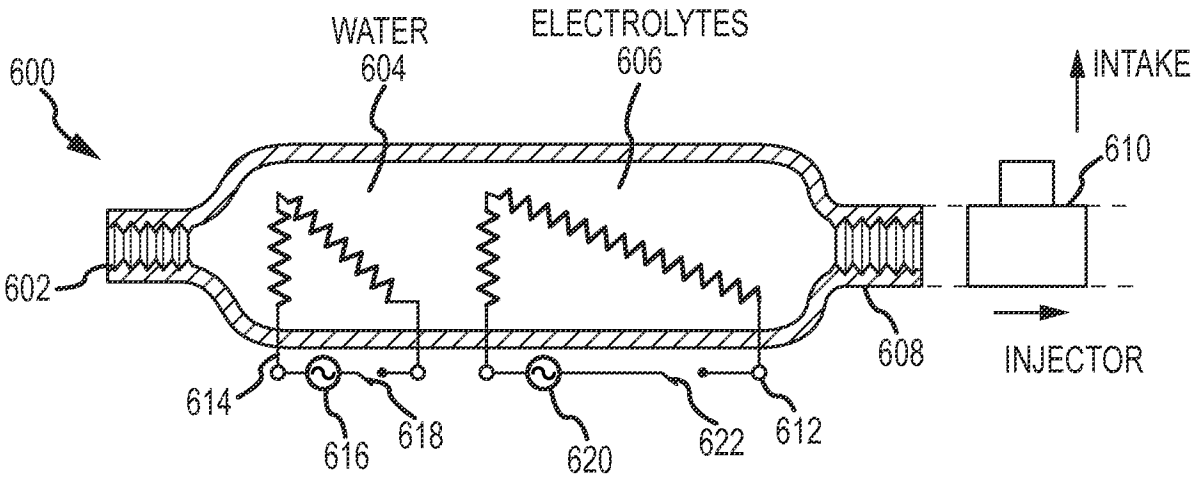
FIG. 6 is a diagramatic representation of a processing system according to a representative embodiment.

FIG. 6 schematically illustrates a processing system 600 according to a representative embodiment for preconditioning or processing fuel dielectrics such as natural gas to assure that adequate dielectric strength is provided. This system provides for phase changes, chemical reactions, various types of filtration, and/or other provisions for removal of impurities such as water and/or water vapor, hydrogen sulfide, and various other potential sources of ions. In some embodiments, the moisture content, ion current, ionization potential, and/or conductivity of the processed fuel is continuously monitored with a suitable apparatus such as that depicted in FIG. 3.

In operation of one embodiment, natural gas including various constituents and impurities enters port 602 and is processed in zone 604 to remove moisture by a desiccant and thus prevent condensation in the fluid circuit that follows. Dried fluid passes into zone 606 for removal of potential ion sources and conductive substances by neutralization and/or adsorption on media such as activated carbon. Dielectric fluids are tested in zone 608 by one or more instrumentation components such as suitable versions of the system in FIG. 3 and after verification of suitable dielectric strength, pass through three-way valve 610 for utilization in devices such as shown in FIGS. 1, 2, and 4A-4B.

Fluid that does not qualify for such dielectric strength service is diverted by three way valve 610 to other applications such as serving as fuel to be consumed in a combustion chamber of a heat engine following admission through the intake valve. Resistance, induction or radiative heating may be provided by occasional operation of circuits 614, 616, 618 and/or 612, 620, 622 to mobilize moisture and/or other substances for delivery through three way valve 610 to applications that do not require high dielectric strength fluid.

In certain large engine embodiments, such as stationary power generators or marine applications, impurities that could cause degradation of the dielectric strength of the fuel may be detected by a sensor such as shown in FIG. 3. If impurities are detected the fuel is routed to one or more canisters of a temperature and/or pressure swing filter media to process the suspect fuel sufficiently to achieve the desired dielectric strength.

Figure 7:
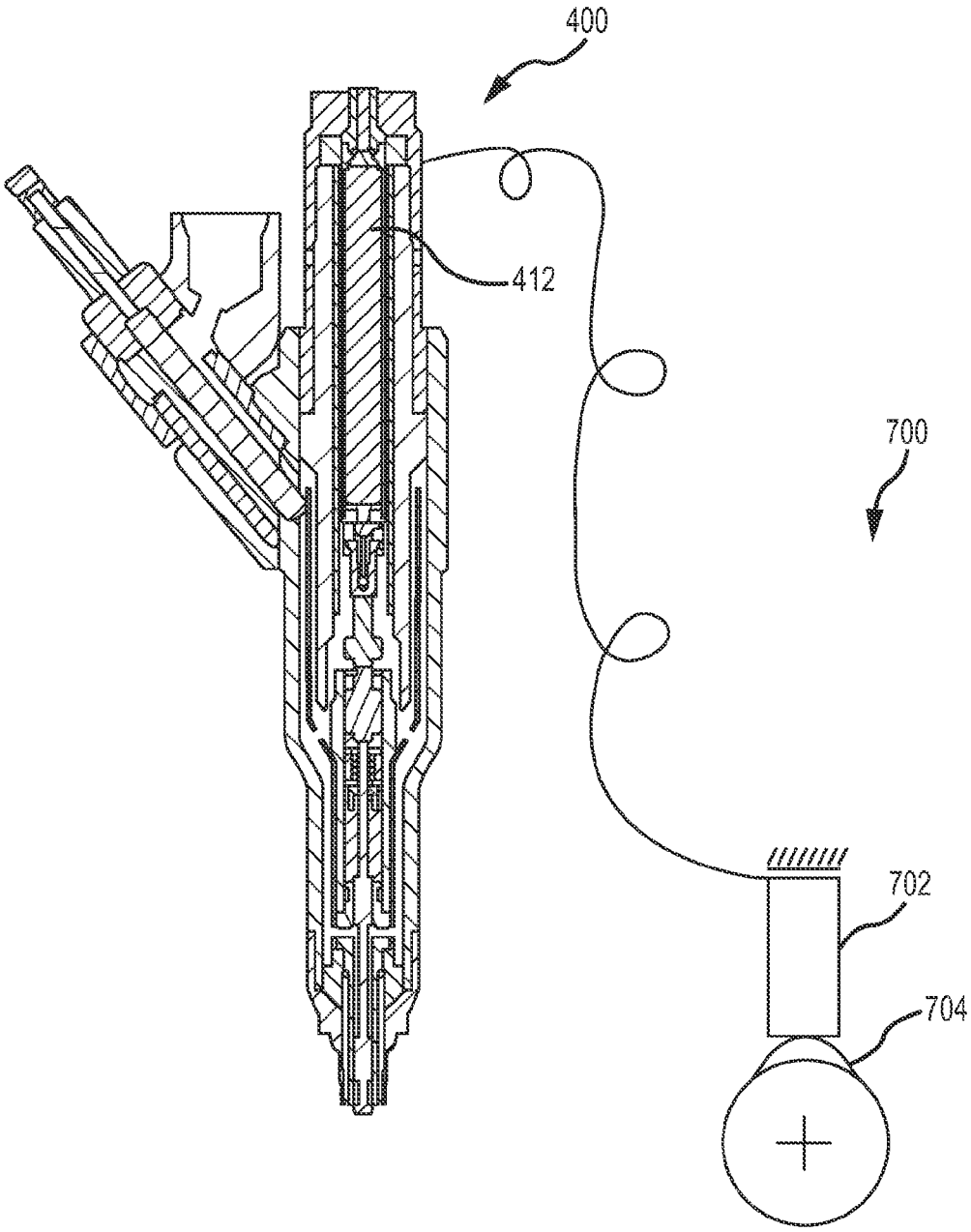
FIG. 7 is a diagramatic representation of a piezoelectric generator system according to a representative embodiment.

FIG. 7 represents application of a piezoelectric generator system 700 including one or more piezoelectric generators 702, which produces the signal or power to operate one or more piezoelectric valve actuators 412. Engine embodiments, such as disclosed in U.S. Patent Application Publication 2011/0041784, the disclosure of which is incorporated herein by reference in its entirety, use a cam driven piezoelectric generator assembly such as a rotary cam 704 to provide the timing and power to operate one or more piezoelectric fuel control valve actuators 412 and/or fuel control valve actuators, such as electromagnetic solenoid, magnetostrictive, pneumatic, or hydraulic selections.

Figure 9:
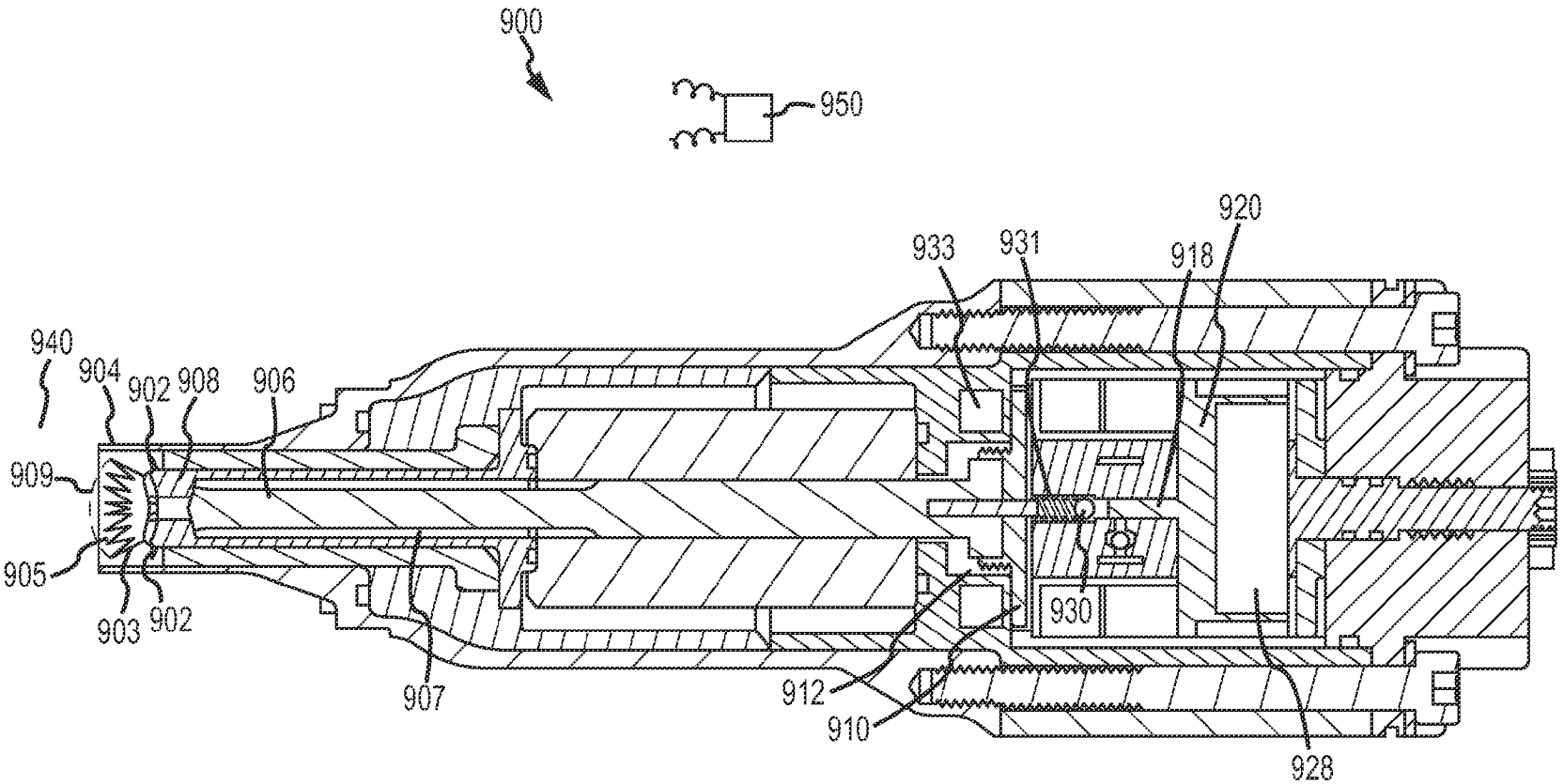
FIG. 9 is a cross-sectional side view in elevation of an injector-igniter according to yet another representative embodiment.

FIG. 9 illustrates injector-igniter 900 according to another representative embodiment. Injector-igniter 900 is suitable for stratified heat production by Lorentz acceleration of ionized oxidant and/or fuel constituents. Valve 906 is rapidly opened inward against fuel pressure by transfer of kinetic energy initially established by armature 910 to valve 906 through cap 912 as shown. Compression spring 931 and/or permanent magnet 933 returns armature 910 to close valve 906. Similarly spring 931 closes check valve 930.

Lorentz acceleration may be provided one or more times in conjunction with or during the time that oxidant is delivered from the combustion chamber into the annular gap between electrodes 902 and 904 and/or when fuel control valve 906 is opened to produce one or multibursts of activated fuel. Such Lorentz ion accelerations provides densification and rarification events for ions and other particles that are swept from the relatively small gap between electrodes 902 and 904 to the larger annular gap between electrodes 904 and 903. This allows a relatively small voltage applied to the small gap between electrode 902 and 904 to initiate an ionized particle current that greatly reduces the impedance of the voltage containment circuit and allows much larger ion currents to quickly develop, and in some modes of operation achieve sonic or supersonic launch velocities into combustion chamber 940. Adaptive adjustments of the timing of such Lorentz accelerations include timing of the beginning, duration, and time between successive bursts and the magnitude of each acceleration. Ignition through Lorentz thrusting is known to those of skill in the art and is described in more detail in U.S. Pat. No. 4,122,816, the disclosure of which is incorporated herein by reference in its entirety.

Figure 8A:
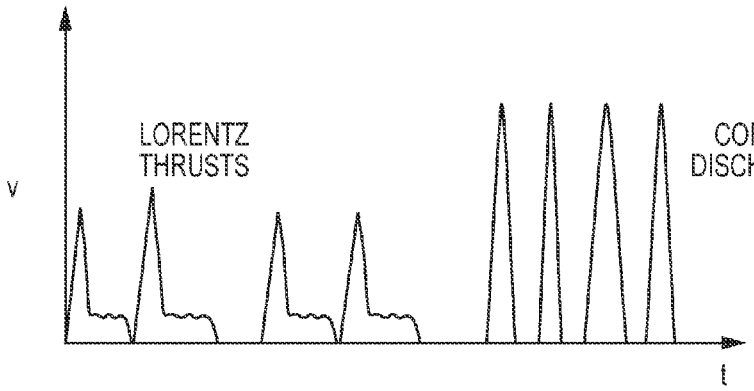
FIG. 8A is a graph illustrating Lorentz and corona discharge events as a function of time.
Figure 8B:
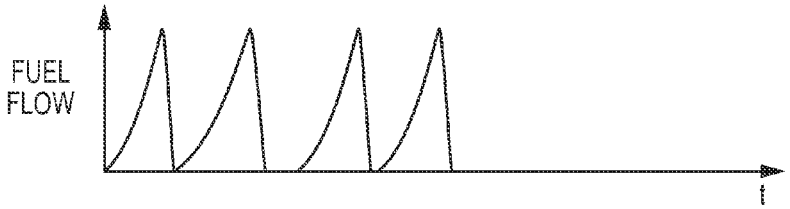
FIG. 8B is a graph illustrating fuel flow events as a function of time.
Figure 8C:
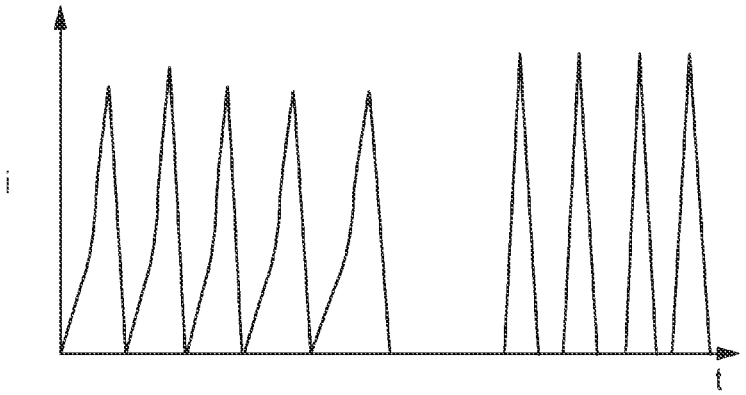
FIG. 8C is a graph illustrating current discharge as a function of time.

For example, controller 950 provides ionization of substances in gaps typical to the space between 902 and 904 to produce a relatively small current and greatly reduce the circuit impedance and thus enable suddenly increased current as shown in FIGS. 8A-8C to be developed along with corresponding Lorentz acceleration to control exit velocities ranging from subsonic to supersonic magnitudes. In addition to greatly reducing the voltage requirement to initiate an ion current in the small gaps between "sharp" electrode edges or points, the pressure required is correspondingly reduced for adequate dielectric strength of the fluid dielectric substance. The voltage containment for Lorentz ion thrusting in such circumstances is much lower than the voltage containment required for conventional corona energy conversion. Therefore, depending upon the pressure measured in critical fluid dielectric regions of injector-igniter 900, Lorentz thrusting may be allowed by Controller 950 but corona discharge is held in abeyance. Control of the magnitudes of launch velocities of activated oxidants and or activated fuel constituents provide for reducing the time to initiate and/or to complete combustion operations. Activated oxidants including ions and other particles that are swept along by such ions may be launched at velocities that are subsequently overtaken by higher velocity activated fuel ions to accelerate initiation and completion of fuel combustion to optimize brake mean effective pressure (BMEP) by stratified charge heat production in the combustion chamber. In certain modes of operation one or more corona discharges in the pattern established by ions projected into the combustion chamber follows to further refine and optimize stratified combustion and heat generation events. Corona discharge into and following such Lorentz thrust ion patterns are much more efficient in accomplishing improved thermal efficiency in engine operations than conventional corona discharge ignition.

Also shown in FIG. 9 is another type of Lorentz thrust operation in which a permanent magnet 928 and an electromagnet 920 provide reciprocating displacement of plunger 920 to force attached piston 918 to provide pumping of dielectric fuel/fluid past check valve 930 to produce an accumulated inventory of pressurized voltage-containment fuel within the annular volumes past check valve 930. In operation, a suitable actuator such as electromagnet, magnetostrictive or piezoelectric valve mechanism moves valve 906 from the seat provided in electrode 908 to allow fuel to flow from the annular space around valve 906 for occasional delivery of dielectric fuel between electrodes 902 and 904.

Providing accumulator volume in zone 907 that is pressurized between injection events by pump 918 minimizes the pressure drop during each injection event. Accordingly, improved pressure maintenance assures effective penetration of fuel into compressed air within the combustion chamber and enables controller 950 to more accurately provide adjusted delivery pressures and amounts of fuel to meet widely varying fuel selections and load conditions.

FIG. 9 also shows the type of fuel injection and ignition system that is suitable for stratified heat production within an oxidant by Lorentz acceleration of ionized oxidant and/or fuel constituents along with corona energy conversion to produce ionization at a distance from a suitable electric field antenna 905. As shown in FIGS. 8A-8C, corona discharge of electrical field energy that is rapidly applied and discharged at a distance from antenna 905 occurs in a moving pattern established by the preceding Lorentz acceleration and projection of one or more patterns of ions that are thrust into the combustion chamber. One or more such corona discharges are adaptively made at rates including frequencies that are less or that exceed the production rate of an ion current in the smallest gap from antenna 905 to electrode 904 or another conductive solid.

Antenna 905 may be exposed or covered with dielectric fluid and/or a suitable protective cover 909 that provides protection against oxidation and other degradation. Materials suitable for protective cover 909 include ceramics such as spinels, alumina, fused quartz, silicon nitride, and various composites. Multiple antennas 905 may be placed in an array to shape the corona discharge by adaptive angles.

Figure 10:
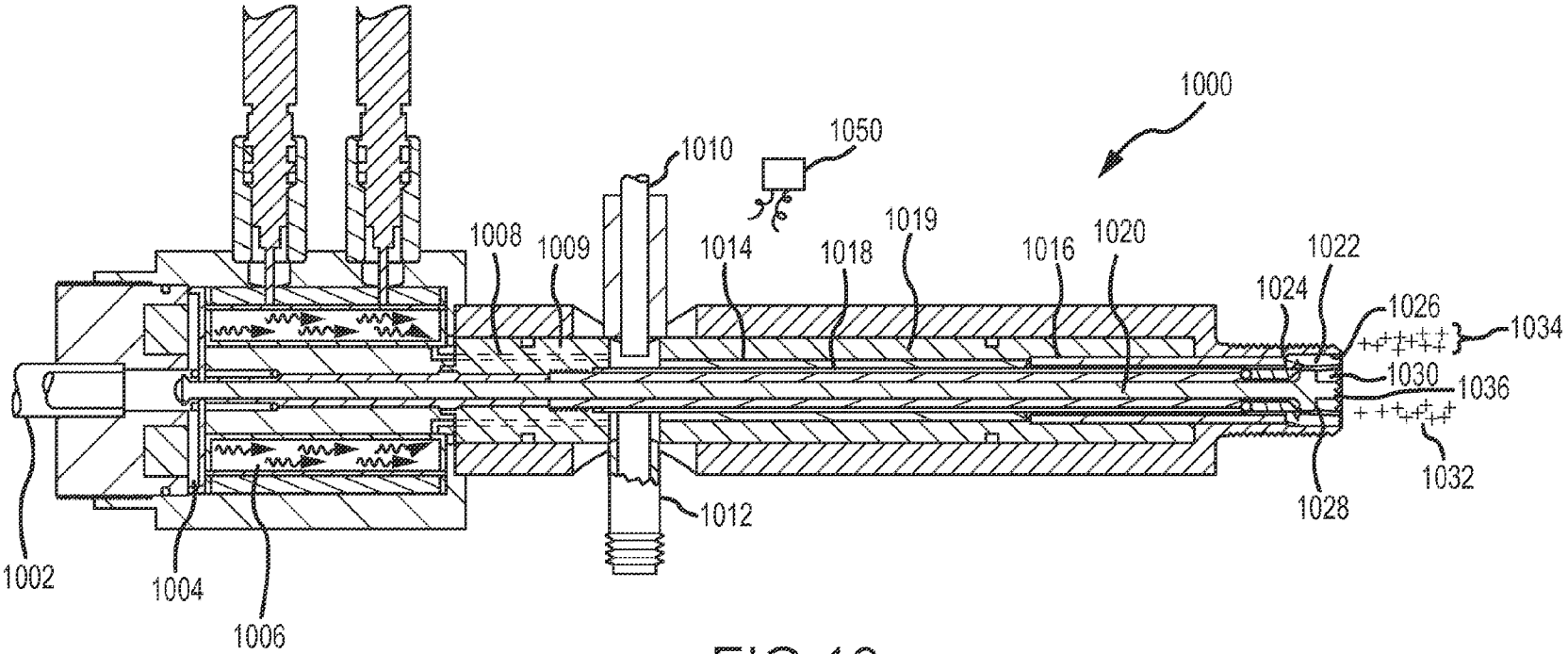
FIG. 10 is a cross-sectional side view in elevation of an injector-igniter according to a still further representative embodiment.

FIG. 10 illustrates injector-igniter 1000 according to yet another representative embodiment. Injector-igniter 1000 is controlled by computer 1050 in which a first dielectric fluid selection is provided through conduit 1002 to perform cooling of valve actuator assemblies such as a piezoelectric motor and/or an electromagnetic assembly including an armature 1004 that is directly or indirectly connected to outwardly opening valve 1020 from a valve seat formed on conductive tubing 1018. In instances that an electromagnetic assembly is included, the first dielectric fluid may also be routed to circulate through windings 1006 of the valve actuator assembly and may be delivered through conduits or passageways 1008 to dielectric passageway 1014 within solid dielectric and/or capacitor 1019 surrounding conductive tube 1018 to provide voltage containment of ignition voltage deliveries through conduit 1010. Fluid dielectric supplied through conduit 1002 may provide crack filling and/or healing substances to maintain the capabilities of solid insulators including insulator body 1009, tubular component 1016, and/or the insulation system on conductive core 1010.

Another dielectric fluid may be provided through conduit 1012 to supply fluid such as fuel and/or cooling fluid through passageway 1014 for occasional entry upon opening of valve 1020 into combustion chamber 1034. Sharp edge or points 1024 provide a relatively small gap distance to concentric electrode 1026 to enable relatively low voltage of about 20 KV to about 40 KV to initiate an ion current that greatly reduces the impedance to allow a much larger current to be established. Such ion currents are accelerated toward the combustion chamber 1034 by the Lorentz linear motor thrust produced by the electric field established between concentric electrodes 1026 and 1028. The accelerating ion current may be swirled by the field of one or more electromagnets or permanent magnets 1030. Adjustments of the supply pressures of dielectric fluid provided through conduits 1002 and/or 1012, the polarity and current magnitudes produced between electrodes 1026 and 1028, and the strength of magnet assembly 1030 each provide adjustment of the pattern of ions 1032 that are projected into combustion chamber 1034.

The launch velocity and pattern of fluid 1032 is established by the pressure drop through ports 1022 and/or the Lorentz acceleration of ions produced and thrust away from electrodes 1024. Similar thrusts of ions may be produced from substances such as air or other oxidants that enter the annular space between electrodes 1026 and 1028 during the intake and/or compression and/or exhaust cycle of chamber 1034.

Thus, multitudes of activated oxidants, including ozone and oxides of nitrogen as well as other ions may be injected to form a stratified charge of oxidizing ions that are subsequently overtaken by high velocity projections of fuel fluids, including ions that are produced by current initiated between electrodes 1024 and 1026 that can be magnified as the impedance drops due to ion currents accelerating along the annular passageway between electrodes 1026 and 1028.

Further impetus to acceleration of the beginning and completion of fuel combustion may be adaptively administered by controller 1050 to interplay relatively slow Lorentz field production with much more rapid application of an electric field by antenna 1036 to produce ionizing corona discharge at a distance in the moving pattern of stratified charge oxidant and/or fuel ions 1032 in combustion chamber 1034.

Figure 11:
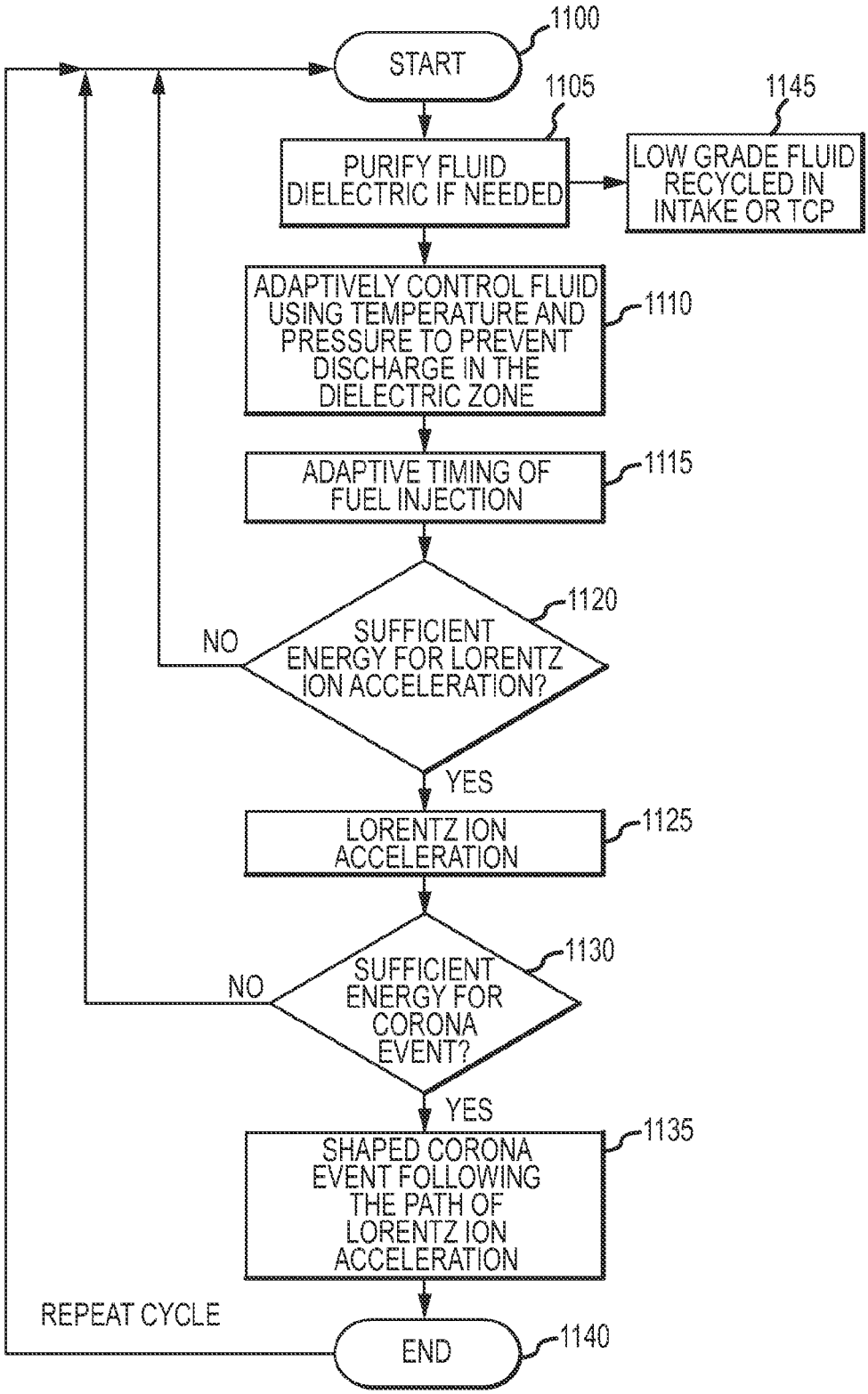
FIG. 11 is a flow chart illustrating a method of using fuel as a dielectric according to a representative embodiment.

Also contemplated herein are methods of using fuel as a dielectric in devices, such as injector-igniters, for example. The methods may include any procedural step inherent in the structures and systems described herein. With reference to FIG. 11, a method 1100 according to a representative embodiment comprises purifying fluid dielectric if needed at step 1105. Low grade fluid is recycled into the engine intake or in a thermo-chemical process (see FIG. 6) at step 1145. At step 1110 the fluid is adaptively controlled using temperature and pressure to prevent discharge in the dielectric zone. The fuel is injected at step 1115 according to adaptive timing (see FIGS. 8A-8C). At step 1120, a determination is made as to whether sufficient need and/or energy for Lorentz ion acceleration exists. If not, then the process starts again at 1100. If there is sufficient energy, Lorentz ion acceleration is initiated. Next, at step 1130 a determination is made as to whether sufficient need and/or energy for a corona discharge event exists. If not, then the process starts again at 1100. If there is sufficient energy, a shaped corona event is initiated which follows the path of the Lorentz ion acceleration. At 1140 the cycle ends and returns to 1100 to repeat.

From the foregoing it will be appreciated that, although specific embodiments of the technology have been described herein for purposes of illustration, various modifications may be made without deviating from the spirit and scope of the technology. Further, certain aspects of the new technology described in the context of particular embodiments may be combined or eliminated in other embodiments. Moreover, while advantages associated with certain embodiments of the technology have been described in the context of those embodiments, other embodiments may also exhibit such advantages, and not all embodiments need necessarily exhibit such advantages to fall within the scope of the technology. Accordingly, the disclosure and associated technology can encompass other embodiments not expressly shown or described herein. The following examples provide additional embodiments of the present technology.

EXAMPLES

1. An ignition system for igniting a fuel, comprising:
   - a voltage potential generation means;
   - an electrically conductive means for conveying a voltage generated by the voltage potential generation means;
   - a combination of a solid dielectric means and a fluid dielectric means for insulating the electrically conductive means; and
   - a delivery means for delivering the voltage to cause ignition of the fuel.

2. The system of example 1, wherein the fluid dielectric means includes at least one of an inert dielectric substance and the fuel.

3. The system of example 1, further comprising a fluid processing means for removing fluid impurities from the fluid dielectric means, wherein the fluid processing means includes a fluid-impurities collection means for collecting the fluid impurities for later use.

4. The system of example 3, wherein the fluid processing means comprises cooling the fluid dielectric means to a cryogenic temperature.

5. The system of example 3, further comprising a sensor means for sensing impurities in the fluid dielectric means.

6. A system for transferring and igniting a fluid fuel, comprising:

a voltage potential generation means;

a conductive means for conveying a voltage generated by the voltage potential generation means;

a combination of a solid dielectric means and a fluid dielectric means for insulating the conductive means;

a transfer means for transferring the fluid fuel; and a delivery means for delivering the voltage to cause ignition of the fuel.

7. The system of example 6, further comprising an adaptive timing means for repeated delivery of the fluid fuel and an ionization means for ionizing the fuel.

8. A fuel injector-igniter, comprising:

an injector housing;

an actuator body disposed in the housing;

a conductor sleeve supported between the actuator body and injector housing with a first annular gap between the injector housing and the conductor sleeve; and a second annular gap between the actuator body and conductor sleeve;

wherein the first and second annular gaps are in fluid communication with a fuel inlet, whereby fuel provides a dielectric between the conductor sleeve and the injector housing.

9. The fuel injector-igniter according to example 8, further comprising an outwardly opening valve.

10. The fuel injector-igniter according to example 9, further comprising a piezoelectric actuator and a hydraulic stroke amplifier disposed in the actuator body and operatively connected to the outwardly opening valve.

11. The fuel injector-igniter according to example 8, wherein fuel provides a dielectric between the conductor sleeve and actuator body.

12. The fuel injector-igniter according to example 8, wherein the injector-igniter is adapted to use compressed natural gas.

13. The fuel injector-igniter according to example 8, further comprising a first electrode electrically connected to the conductor sleeve and a second electrode electrically connected to the housing.

14. A system for transferring and igniting a fuel, comprising:

a fuel supply;

a cryogenic fuel processor connected to the fuel supply and operative to remove impurities from fuel supplied therefrom;

a power supply; and an injector-igniter, including:

an injector housing connected to the power supply and having a fuel inlet connected to the fuel processor;

an actuator body disposed in the housing;

a conductor sleeve connected to the power supply and supported between the actuator body and injector housing with a first annular gap between the injector housing and the conductor sleeve; and a second annular gap between the actuator body and conductor sleeve;

wherein the first and second annular gaps are in fluid communication with the fuel inlet, whereby fuel provides a dielectric between the conductor sleeve and the injector housing; and a first electrode electrically connected to the conductor sleeve and a second electrode electrically connected to the housing.

15. The system according to example 14, wherein fuel provides a dielectric between the conductor sleeve and actuator body.

16. The system according to example 14, wherein the injector-igniter is adapted to use compressed natural gas.

17. The system according to example 14, wherein fuel processor includes an impurity collector.

18. The system according to example 14, further comprising a piezoelectric actuator disposed in the actuator body.

19. The system according to example 18, further comprising an outwardly opening valve.

20. The system according to example 19, further comprising a hydraulic stroke amplifier disposed in the actuator body and operatively connected between the piezoelectric actuator and the outwardly opening valve.

We claim:

1. An ignition system for igniting a fuel, comprising:

a voltage potential generation means;

an electrically conductive means for conveying a voltage generated by the voltage potential generation means;

a combination of a solid dielectric means and a fluid dielectric means for insulating the electrically conductive means; and a delivery means for delivering the voltage to cause ignition of the fuel.

2. The system of claim 1, wherein the fluid dielectric means includes at least one of an inert dielectric substance and the fuel.

3. The system of claim 1, further comprising a fluid processing means for removing fluid impurities from the fluid dielectric means, wherein the fluid processing means includes a fluid-impurities collection means for collecting the fluid impurities for later use.

4. The system of claim 3, wherein the fluid processing means comprises cooling the fluid dielectric means to a cryogenic temperature.

5. The system of claim 3, further comprising a sensor means for sensing impurities in the fluid dielectric means.

6. A system for transferring and igniting a fluid fuel, comprising:

a voltage potential generation means;

a conductive means for conveying a voltage generated by the voltage potential generation means;

a combination of a solid dielectric means and a fluid dielectric means for insulating the conductive means;

a transfer means for transferring the fluid fuel; and a delivery means for delivering the voltage to cause ignition of the fuel.

7. The system of claim 6, further comprising an adaptive timing means for repeated delivery of the fluid fuel and an ionization means for ionizing the fuel.

8. A fuel injector-igniter, comprising:

an injector housing;

an actuator body disposed in the housing;

a conductor sleeve supported between the actuator body and injector housing with a first annular gap between the injector housing and the conductor sleeve; and a second annular gap between the actuator body and conductor sleeve;

wherein the first and second annular gaps are in fluid communication with a fuel inlet, whereby fuel provides a dielectric between the conductor sleeve and the injector housing.

9. The fuel injector-igniter according to claim 8, further comprising an outwardly opening valve.

10. The fuel injector-igniter according to claim 9, further comprising a piezoelectric actuator and a hydraulic stroke amplifier disposed in the actuator body and operatively connected to the outwardly opening valve.

11. The fuel injector-igniter according to claim 8, wherein fuel provides a dielectric between the conductor sleeve and actuator body.

12. The fuel injector-igniter according to claim 8, wherein the injector-igniter is adapted to use compressed natural gas.

13. The fuel injector-igniter according to claim 8, further comprising a first electrode electrically connected to the conductor sleeve and a second electrode electrically connected to the housing.

14. A system for transferring and igniting a fuel, comprising:

a fuel supply;

a cryogenic fuel processor connected to the fuel supply and operative to remove impurities from fuel supplied therefrom;

a power supply; and an injector-igniter, including:

an injector housing connected to the power supply and having a fuel inlet connected to the fuel processor;

an actuator body disposed in the housing;

a conductor sleeve connected to the power supply and supported between the actuator body and injector housing with a first annular gap between the injector housing and the conductor sleeve; and a second annular gap between the actuator body and conductor sleeve;

wherein the first and second annular gaps are in fluid communication with the fuel inlet, whereby fuel provides a dielectric between the conductor sleeve and the injector housing; and a first electrode electrically connected to the conductor sleeve and a second electrode electrically connected to the housing.

15. The system according to claim 14, wherein fuel provides a dielectric between the conductor sleeve and actuator body.

16. The system according to claim 14, wherein the injector-igniter is adapted to use compressed natural gas.

17. The system according to claim 14, wherein fuel processor includes an impurity collector.

18. The system according to claim 14, further comprising a piezoelectric actuator disposed in the actuator body.

19. The system according to claim 18, further comprising an outwardly opening valve.

20. The system according to claim 19, further comprising a hydraulic stroke amplifier disposed in the actuator body and operatively connected between the piezoelectric actuator and the outwardly opening valve.

* * * * *